US007097297B2

(12) United States Patent
Hasebe et al.

(10) Patent No.: US 7,097,297 B2
(45) Date of Patent: Aug. 29, 2006

(54) INK JET PRINTER, AND IMAGE PRINTING APPARATUS HAVING THE PRINTER

(75) Inventors: Takashi Hasebe, Tokyo (JP); Saburo Shimizu, Tokyo (JP); Tetsu Sekine, Tokyo (JP); Shuta Hamada, Tokyo (JP)

(73) Assignee: Konica Minolta Holdings Inc., Tokyo (JP)

( * ) Notice: Subject to any disclaimer, the term of this patent is extended or adjusted under 35 U.S.C. 154(b) by 183 days.

(21) Appl. No.: 10/686,350

(22) Filed: Oct. 14, 2003

(65) Prior Publication Data

US 2004/0080598 A1 Apr. 29, 2004

(30) Foreign Application Priority Data

Oct. 23, 2002 (JP) ..... 2002-308284
Nov. 7, 2002 (JP) ..... 2002-323644

(51) Int. Cl.
*B41J 2/01* (2006.01)

(52) U.S. Cl. ..... 347/102; 347/101

(58) Field of Classification Search ..... 347/102, 347/101, 104; 101/488
See application file for complete search history.

(56) References Cited

U.S. PATENT DOCUMENTS 4,089,008 A 5/1978 Suga et al.
4,991,506 A * 2/1991 Rodi ..... 101/416.1
5,258,809 A * 11/1993 Wiedemer ..... 399/112
5,432,537 A 7/1995 Imakawa et al.
6,192,213 B1 * 2/2001 Wada et al. ..... 399/306
6,454,405 B1 9/2002 Stowe
6,460,991 B1 10/2002 Temple et al.
6,523,948 B1 * 2/2003 Matsumoto et al. ..... 347/102
2001/0033408 A1 10/2001 Shiraishi et al.
2003/0081096 A1 5/2003 Young

FOREIGN PATENT DOCUMENTS

JP 55029843 A * 3/1980
JP 60-119554 B2 6/1985
JP 59133058 A * 7/1985
JP 61-114817 6/1986
JP 61268466 A * 11/1986
JP 60-200204 A 7/1994
JP 07144403 A * 6/1995
JP 2001-158865 A 6/2001
JP 2001-328297 A 11/2001
JP 2002-144553 A 5/2002
WO 97/31071 A1 8/1997

OTHER PUBLICATIONS

Patent Abstracts of Japan, vol. 010, No. 301, (M-525), Oct. 14, 1986 and JP 61-114617 A (FUJITSU LTD.), Jun. 2, 1986—Abstract only.

* cited by examiner

*Primary Examiner*—Manish Shah
*Assistant Examiner*—Leonard Liang
(74) *Attorney, Agent, or Firm*—Frishauf, Holtz, Goodman & Chick, P.C.

(57) ABSTRACT

This invention relates to an ink jet printer including a printing-head which discharges photo-curing ink toward a printing sheet, and a light irradiation unit which irradiates the ink landing surface of the printing sheet with light, wherein the light irradiation unit irradiates the ink landing surface by optical scanning via a reflecting member with rays having a wavelength range in which ink is cured, and an image printing apparatus having the ink jet printer.

10 Claims, 6 Drawing Sheets

INK JET PRINTER, AND IMAGE PRINTING APPARATUS HAVING THE PRINTER

BACKGROUND OF THE INVENTION

1. Field of the Invention

The present invention relates to an ink jet printer and an image printing apparatus having the printer and, more particularly, to an ink jet printer using photo-curing ink which is advantageous to increasing the image printing speed.

2. Description of the Prior Art

An ink jet image printing method of photo-curing type such as ultraviolet curing type can print on various base materials without any dedicated image-receiving layer, and is a technique which receives a great deal of attention mainly for business and industrial purposes. In ultraviolet curing ink jet image printing, an active species is generally produced within a short time by using a high-power light source such as a high-pressure mercury lamp or metal halide lamp, thus promoting ink curing.

In the use of a high-power light source, the ink film characteristic readily degrades after curing, which is unprofitable in terms of power saving and downsizing of the printer. A long time is taken to obtain a printed image by light irradiation on the entire printing surface subsequent to ink jet printing, and the printer inevitably becomes bulky.

To solve this problem, Japanese Unexamined Patent Publication No. 2002-144553 discloses that a printer is so constituted as to follow and irradiate an ink landing position by an ultraviolet light spot guided from an ultraviolet source via an optical fiber, ink can be cured even by a small-output light source, and the image printing speed can also be shortened by almost simultaneously performing ink jet printing and ultraviolet irradiation.

According to the method disclosed in Japanese Unexamined Patent Publication No. 2002-144553, when a serial type on-demand ink jet head is used, the total image printing speed can be increased to a certain degree in correspondence with an increase in ink jet printing speed by executing light spot irradiation in cooperation with head scanning. If a line type on-demand ink jet head advantageous to further increasing the ink jet printing speed is used, an increase in speed is limited due to a restriction by the light spot irradiation speed of ultraviolet rays in mechanically moving the irradiation position.

In recent years, color image printing apparatuses adopt an ink jet printing system which has widely spread for personal use. The ink jet printing system directly prints a color image on a printing sheet, and can print an image without any complicated reversal delivery mechanism for printing images on two sides. The ink jet printing system directly sprays ink from the printing-head to a printing sheet. In order to fix the image, printing sheet and image must be satisfactorily dried. At a portion where printing sheets overlap each other after delivery when images are printed on many printing sheets, drying is insufficient, and images blur (ink transfers or smears) owing to contact between the sheets. This problem is also caused by an additive which is contained in ink in order to prevent nozzle clogging.

To solve this problem, there is proposed the use of ultraviolet curing ink (see, e.g., Japanese Unexamined Patent Publication No. 2001-158865).

There is also proposed an ink jet printer which comprises two printing-heads and increases the speed by coupling U- and 8-shaped convey paths and combining convey procedures and printing orders in double-side printing and single-side printing (see, e.g., Japanese Unexamined Patent Publication No. 2001-328297).

There is also proposed an ink jet printer in which ultraviolet curing ink is used, ultraviolet rays are guided close to a printing-head from an ultraviolet irradiation device via an optical fiber, and an ink landing position on a printing sheet is followed and irradiated to cure ink immediately after each printing (see, e.g., Japanese Unexamined Patent Publication No. 2002-144553).

Japanese Unexamined Patent Publication No. 2001-328297 requires many main driving levers for controlling a printing sheet convey direction. When the printing speed is further increased, control of the main driving levers becomes very cumbersome, generating noise and impairing reliability and durability.

The method in Japanese Unexamined Patent Publication No. 2002-144553 is suitable when the printing-head prints while moving in the main scanning direction (direction perpendicular to the printing sheet convey direction). If printing-heads are linearly arrayed in the main scanning direction and mechanically moved to print in the main scanning direction in order to further increase the speed, ultraviolet rays must be arrayed in the main scanning direction similarly to the printing-heads, greatly increasing the cost.

SUMMARY OF THE INVENTION

The present invention has been made to overcome the conventional drawbacks, and has as its first object to provide an ink jet printer which uses photo-curing ink and can further increase the image printing speed of a photo-curing ink jet image printing method.

It is the second object of the present invention to provide an image printing apparatus of an ink jet printing system that has high reliability and durability with a simpler convey path, convey control, and image printing order control, and can print a color image at high speed regardless of single-side or double-side printing.

To achieve the first object, according to the first main aspect of the present invention, there is provided an ink jet printer comprising a printing-head which discharges photo-curing ink toward a printing sheet, and a light irradiation unit which irradiates an ink landing surface of the printing sheet with light, wherein the light irradiation unit irradiates the ink landing surface by optical scanning via a reflecting member with rays having a wavelength range in which ink is cured.

The reflecting member in the first aspect comprises a polygon reflecting mirror or swingable reflecting mirror.

The ink jet printer in the first aspect can further comprise a detection unit which detects a light quantity, and a light quantity control unit which controls an irradiation energy amount on the basis of the detected light quantity.

To achieve the second object, according to the second main aspect of the present invention, there is provided an image printing apparatus of an ink jet printing system, comprising a rotary drum on which a printing sheet is wound, an ink jet printer which discharges photo-curing ink in order to print an image on the printing sheet wound around the rotary drum, and an irradiation optical path on which an image printing surface of the printing sheet is irradiated with rays having a wavelength at which the photo-curing ink is cured.

To achieve the second object, according to the third main aspect of the present invention, there is provided an image printing apparatus of an ink jet printing system, comprising two rotary drums on which printing sheets can be wound, ink jet printers which discharge photo-curing ink in order to print images on the printing sheets respectively wound around the two rotary drums, and two irradiation optical paths on which image printing surfaces of the printing sheets are irradiated with rays having a wavelength at which the photo-curing ink is cured, wherein rays on one irradiation optical path irradiate the image printing surface of the printing sheet wound around one rotary drum, and rays on the other irradiation optical path irradiate the image printing surface of the printing sheet wound around the other rotary drum.

In the image printing apparatus according to the third main aspect, two rays from two predetermined light sources irradiate a polygon reflecting mirror or swingable reflecting mirror which rotates, and the two rays reflected by the polygon reflecting mirror irradiate the image printing surfaces of the printing sheets via the two irradiation optical paths.

In the image printing apparatus according to the third main aspect, the printing sheet is wound around one rotary drum with one surface facing outward, and then wound around the other rotary drum with the other surface facing outward.

As is apparent from the first main aspect, the present invention provides a compact, power-saving ink jet printer which uses photo-curing ink and can increase the image printing speed.

The image printing apparatus according to the present invention uses two rotary drums, two ink jet printers, and two irradiation optical paths. In double-side image printing, printing sheets can be delivered sequentially from the first page without any switchback mechanisms. The switchback time and complicated convey control can be eliminated, and the present invention can provide an image printing apparatus at high reliability and durability with a simple convey path, convey control, and image printing order control. The printing sheet convey timing and the image printing timings of the two rotary drums are optimized in accordance with the specifications, thus increasing the total speed of the image printing apparatus.

The above and many other objects, features and advantages of the present invention will become manifest to those skilled in the art upon making reference to the following detailed description and accompanying drawings in which preferred embodiments incorporating the principle of the present invention are shown by way of illustrative examples.

DETAILED DESCRIPTION OF THE PREFERRED EMBODIMENTS

Several preferred embodiments of the present invention will be described below with reference to the accompanying drawings. However, the present invention is not limited to them.

An ink jet printer according to the present invention uses photo-curing ink which is composed of a pigment, a monomer serving as the precursor of a polymer compound, and a photo polymerization initiator and photo polymerization accelerating agent which promote cross-linking/polymerization reaction of the monomer by photocatalyst reaction, and is cured by cross-linking/polymerization of the monomer by light irradiation of ultraviolet rays or the like. For example, Japanese Examined Patent Publication No. 5-54667, Japanese Unexamined Patent Publication No. 6-200204, and PCT 2000-504778 disclose ultraviolet curing ink jet ink. Ink is not limited to ultraviolet curing one, and may be one which cures by irradiation of infrared rays or a visible beam.

As ink colors, light magenta (LM), light cyan (LC), light black (LBk), dark yellow (DY), and orange inks are desirably used in addition to Y, M, C, and Bk which are primary reproduction colors converted from R, G, and B. These color inks are selected in accordance with the specification of a requested image, and a specific color ink can also be added by specification setting of the user.

For a specific wavelength range, e.g., ultraviolet range, a unit for forming a point source having a wavelength range in which ink is cured is comprised of an ultraviolet lamp which emits light with stable irradiation energy, and a filter which transmits ultraviolet rays having a specific wavelength into a light spot.

As the ultraviolet lamp, a mercury lamp, metal halide lamp, excimer laser, ultraviolet laser, black light, and LED (Light Emitting Diode) are applicable. A metal halide lamp tube, mercury lamp tube, or black light is preferable. In particular, a black light which emits ultraviolet rays having a wavelength of 250 nm is preferable because it can prevent any blur and efficiently control the dot diameter.

The light source is turned on in correspondence with the image signal of each line that is stored in the memory of an image processing/control section GS, and off for a line having no image signal.

Figure 1:
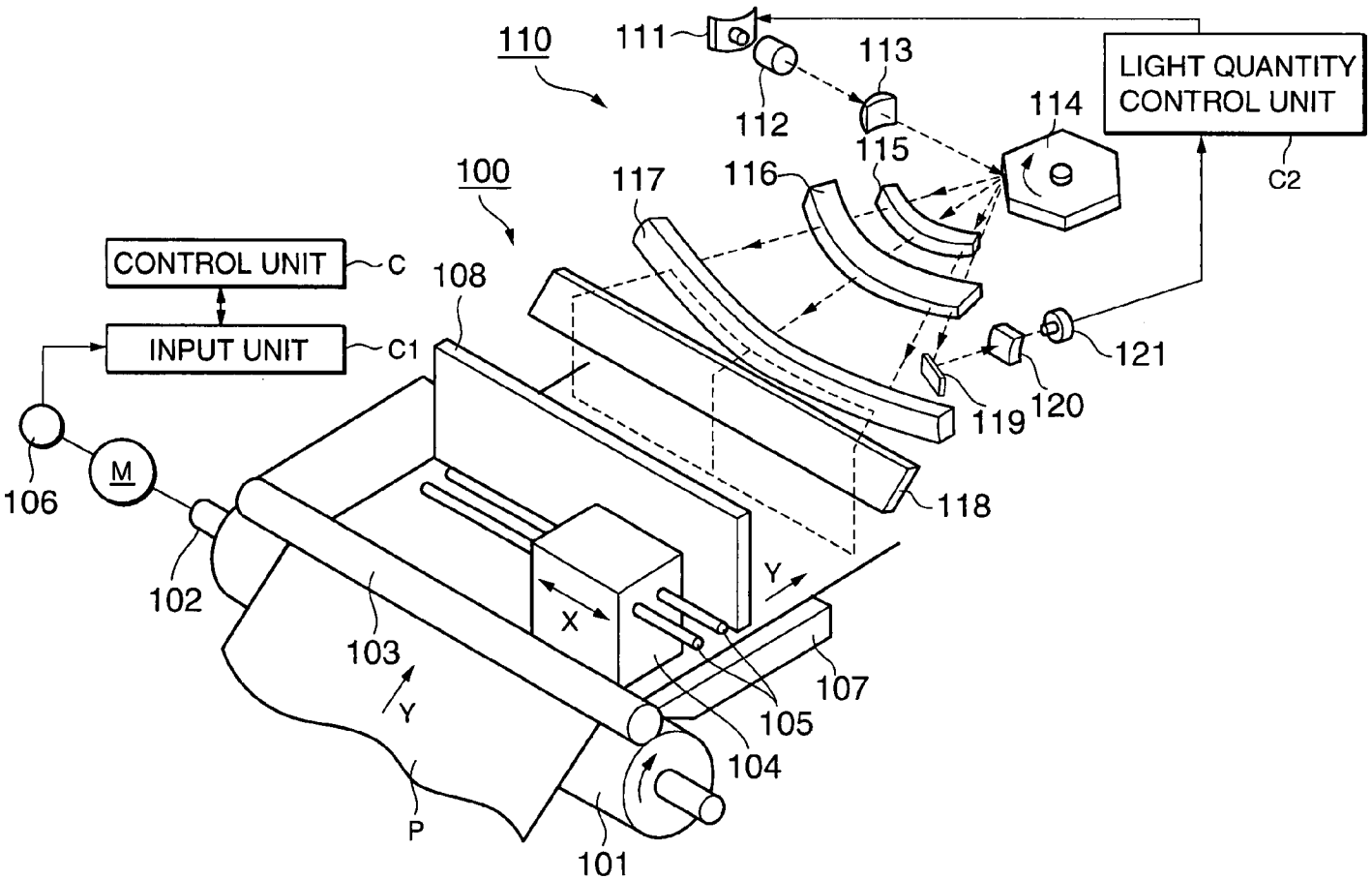
FIG. 1 is a schematic perspective view showing the arrangement of an ink jet printer and the optical system of a light source according to the present invention.

In FIG. 1 showing an arrangement example of an ink jet printer according to the present invention, reference numeral 101 denotes a convey roller. The convey roller 101 is arranged on the lower surface (non-printing surface) side of a printing sheet P in front of a printing-head 104 that discharges photo-curing ink droplets in a convey direction Y of the printing sheet P for printing an image on its surface. The convey roller 101 is rotatably arranged in an ink jet printer 100 via a shaft 102, and conveys a printing sheet for printing an image. A similar convey roller (not shown) is also arranged after the light irradiation region.

FIG. 1 illustrates a carriage type printing-head 104. To increase the printing speed, a full line type printing-head having the width of the printing sheet P serving as a printing medium may be used instead of the printing-head 104.

Reference numeral 103 denotes a nip roller which is arranged at a position where it faces the convey roller 101 via the printing sheet P. The nip roller 103 is pressed against the convey roller 101 at a predetermined pressure. The printing sheet P is clamped between the convey roller 101 and the nip roller 103 to be reliably conveyed. A similar nip roller is also arranged in correspondence with the convey roller (not shown) after the light irradiation region. The attaching position relationship between the convey roller 101 and the nip roller 103 may be reversed via the printing sheet P.

Reference symbol M denotes a motor which has a rotating shaft connected to the shaft 102 of the convey roller 101, and conveys the printing sheet P in the Y direction. The shaft 102 and the shaft of the convey roller after the light irradiation region are connected by a speed-increasing unit (not shown). The convey roller after the light irradiation region is driven at a slightly higher rotational speed than the peripheral speed of the convey roller 101 so as to prevent any slack of the printing sheet P.

The printing-head 104 has a plurality of nozzles which discharge photo-curing ink droplets toward the image printing surface of the printing sheet P. The printing-head 104 selectively discharges ink droplets from nozzles on the basis of an image signal to print an image on the image printing surface of the printing sheet P. The printing-head 104 is guided by guide members 105 parallel to the image printing surface of the printing sheet P in a direction (X direction) perpendicular to the printing sheet convey direction. The printing-head 104 is fixed to part of a driving wire (not shown), and reciprocates by driving the driving wire by a motor (not shown).

Reference numeral 106 denotes an encoder which is connected to the rotating shaft of the motor M, detects the rotation amount of the motor M, and inputs an output to an input/output unit C1. The rotation amount of a motor for driving the driving wire is also detected, and an output is input to the input/output unit C1.

The input/output unit C1 receives outputs from the encoder 106 and an encoder which detects the rotation amount of the motor for driving the driving wire. The input/output unit C1 performs primary processing, and inputs an output to a control unit C. The input/output unit C1 receives, from the control unit C, control output signals for the motor M and the motor for driving the driving wire. The two motors are rotated on the basis of the control output signal.

The control unit C receives an output from the input/output unit C1, and executes arithmetic processing in accordance with a control program stored in advance in a memory (not shown). The arithmetic result is output to the input/output unit C1 to control the motor and the like.

A printing sheet P fed from a feed cassette (not shown) is conveyed in the Y direction by the convey roller rotated by the motor M, and guided between the printing-head 104 and a guide 107 which prevents any slack of the printing sheet P. The printing sheet P may be a sheet, or if a machine-grazed paper supply unit (not shown) is adopted, machine-grazed paper.

The control unit C controls the motor M so as to rotate the convey roller 101 at a predetermined speed in a direction indicated by the arrow. The control unit C calculates an output from the encoder 106 that is input via the input/output unit C1. When the rotation amount of the motor M reaches the convey amount of the printing sheet P that is stored in advance, the control unit C stops the motor M. This operation is sub-scanning.

The control unit C moves the printing-head 104 via the driving wire at a predetermined speed in the X direction. The control unit C calculates an encoder output which is input via the input/output unit C1 to detect the rotation amount of the motor for driving the driving wire. When the moving amount of the printing-head 104 reaches the moving amount of the printing-head 104 that is stored in advance, the control unit C stops the driving motor. This operation is main scanning.

The control unit C alternately repeats main scanning and sub-scanning to calculate the current positions of the printing sheet P and printing-head 104 on the basis of outputs from the two encoders. The control unit C reads out data corresponding to the current positions from image data stored in the memory in advance, and causes the nozzles of the printing-head 104 to selectively discharge ink droplets, thereby printing an image at a predetermined position on the printing sheet P.

In a light irradiation section 110, incident light from a point source formation unit 111 which comprises an ultraviolet lamp, filter, and the like and forms a point source is collimated into parallel light by a collimator lens 112. Parallel light is formed into a spot shape via a cylindrical lens 113 of an imaging optical system, and enters a polygon mirror 114 which rotates. Light which is reflected by the polygon mirror 114 and deflected in the optical path passes through an imaging optical system comprised of an fθ lens 115 and cylindrical lenses 116 and 117, and reflected by a mirror 118 to scan the image printing surface of the printing sheet P.

Light reflected by an index mirror 119 enters via an imaging lens 120 a light quantity sensor 121 serving as a detection unit which detects the light quantity. Detection data of the light quantity sensor 121 is input to a light quantity control unit C2 serving as a light quantity control unit which controls the irradiation energy amount on the basis of the detected light quantity. The light quantity control unit C2 executes arithmetic processing on the basis of the data, controls the point source formation unit 111 for forming a point source on the basis of the arithmetic result, and adjusts the light quantity so as to obtain necessary irradiation energy.

In control of the irradiation energy amount, the number of irradiation operations of light energy based on one optical scanning is counted. Whether energy necessary to cure ink has been irradiated is determined from the irradiation count. If no necessary light energy has been irradiated, the start of feed control is delayed, necessary energy is supplied, and then feed operation starts.

Reference numeral 108 denotes a light-shielding member which prevents reflected light of irradiation light from entering the ink jet printing section.

Figure 2:
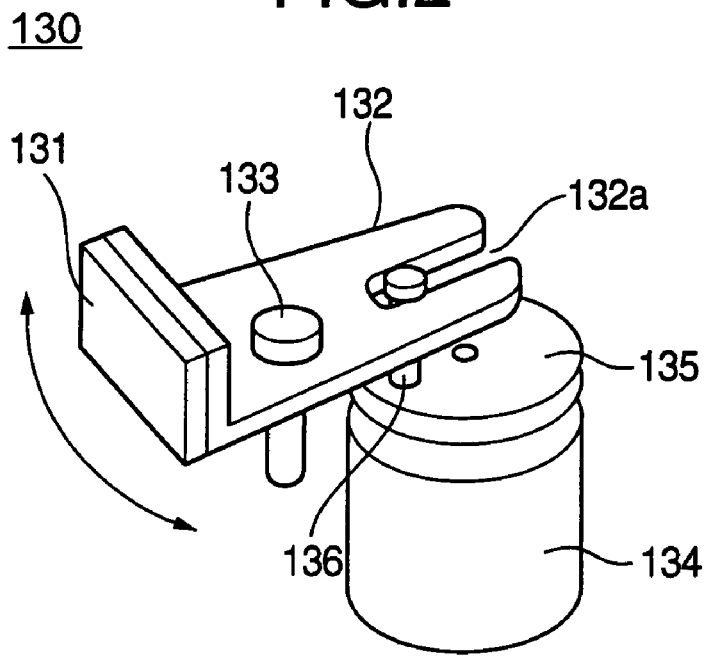
FIG. 2 is a perspective view showing another example of a reflecting mirror used in the ink jet printer according to the present invention.

In this case, the reflecting member is a polygon reflecting mirror advantageous to increasing the image printing speed. As shown in FIG. 2, the reflecting member may be a swing reflecting mirror 130 which is constituted by fitting a pin 136 decentered on a member 135 in a groove 132*a* of a mirror member 132 having a mirror surface 131, and swingably holding the mirror member 132 by a stepped screw 133 held by a holding member (not shown) so as to rotate and the rotating member 135 by a stepping motor 134 or the like and swing the mirror surface, as indicated by the arrow. The reflecting member according to the present invention is not limited to them.

If a beam splitter formed by a half mirror or prism is used, a beam from one light source can be split into two and guided to become incident on a polygon mirror 55 and the reflecting mirror 130. Even one beam emerging from an optical system formed by the polygon mirror 55 and swing reflecting mirror 130 can be split into two by the beam splitter to irradiate two printing sheet support drums.

Figure 3:
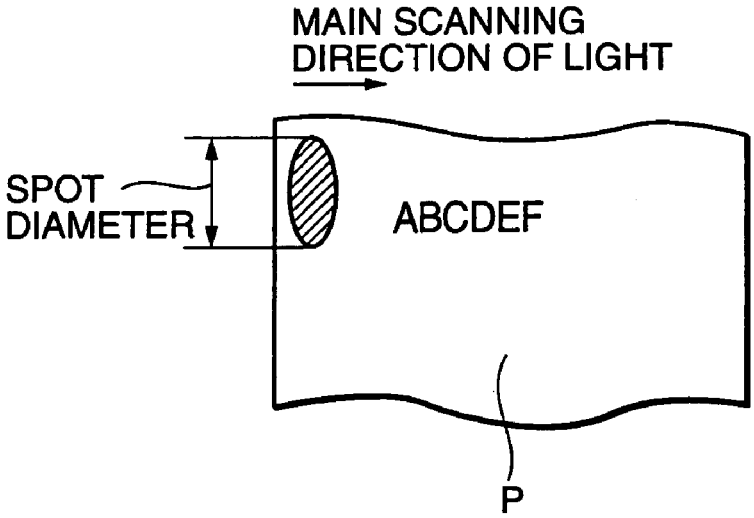
FIG. 3 is a view showing an image of light irradiation on an image printed on a printing sheet.

FIG. 3 is a view showing an image of light irradiation on an ink landing surface (image printing surface of a printing sheet).

During main scanning of the printing-head (i.e., during image printing by ink discharge), no sub-scanning is executed, and a printing sheet stops. At this time, an ink landing surface having a width corresponding to the feed amount is scanned and irradiated with a photo-curable light quantity. FIG. 3 shows a case wherein the ink landing surface is scanned with an elongated light spot whose long diameter side corresponds to the feed amount. The ink landing surface may be reciprocally scanned several times such that small light spots overlap each other. In either case, it is important to irradiate energy necessary for photo-curing reaction of ink. Since a narrow region on the ink landing surface is irradiated with a light spot, this arrangement can realize power saving and downsizing of the ink jet printer without any high-power light source.

In the above-described embodiment, the printing sheet P is held by the guide 107 in the ink jet printing section, and conveyed on the plane. Alternatively, the printing sheet P may be supported by a convey belt and drum and undergo ink jet printing.

Figure 4:
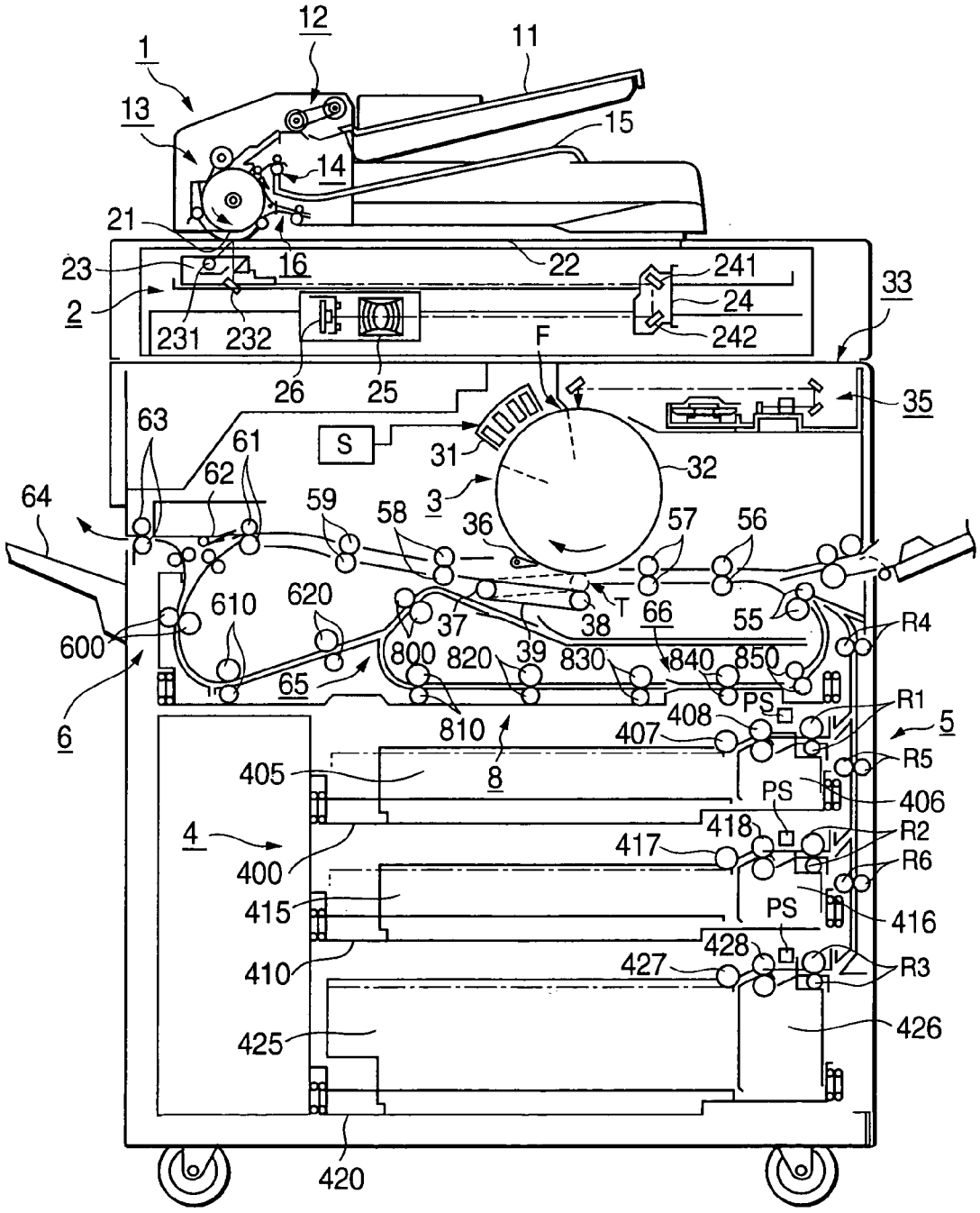
FIG. 4 is a sectional view showing the schematic arrangement of an image printing apparatus according to the first embodiment of the present invention.

FIG. 4 is a schematic view showing the whole arrangement of an image printing apparatus (image printing apparatus of an ink jet printing system) having the above-described ink jet printer according to the first embodiment.

In the image printing apparatus according to the first embodiment, an automatic document feeding device 1 is mounted on the apparatus main body. The apparatus main body incorporates an image reading device 2 serving as an image reading unit, an image printing section 3, a light irradiation section 35, a printing sheet storage section 4, a printing sheet feed section 5, a reversal delivery/refeed section 6, and an ADU 8 serving as a reversal convey unit.

The automatic document feeding device 1 feeds document sheets one by one, conveys them to an image reading position, and delivers the image-read document sheets to a predetermined location. The automatic document feeding device 1 comprises a document table 11 which supports document sheets, a document separation portion 12 which separates the document sheets set on the document table 11, a document convey portion 13 including a plurality of rollers which convey the document sheet separated by the document separation portion 12, a document delivery portion 14 which delivers the document sheet conveyed by the document convey portion 13, a document delivery table 15 which supports the document sheet delivered by the document delivery portion 14, and a document reverse portion 16 which is formed by a pair of rollers for reversing the upper and lower surfaces of the document sheet in reading images on the two surfaces of the document sheet.

Document sheets set on the document table 11 are separated one by one by the document separation portion 12, and conveyed by the document convey portion 13 to an image reading position below the document convey portion 13. At this position, the image of the document sheet is read via a slit 21. The image-read document sheet is delivered onto the document delivery table 15 by the document delivery portion 14.

Images on the two sides of a document sheet are read as follows. A document sheet whose image on one side has been read is guided to the document reverse portion 16. While the trailing end of the document sheet is clamped between the rollers, the rollers are reversely rotated to reverse the document sheet. The document sheet is conveyed again by the document convey portion 13, and an image on the second surface is read at the document reading position.

The automatic document feeding device 1 is retractable. By raising the automatic document feeding device 1 to open a glass document table 22, a document sheet can be directly set on the glass document table 22 and copied.

The image reading device 2 reads a document image to obtain image data. The image reading device 2 comprises a first mirror unit 23 constituted by integrating a lamp 231 which irradiates a document sheet via the slit 21 and a first mirror 232 which reflects light reflected by the document sheet, a second mirror unit 24 constituted by integrating second and third mirrors 241 and 242 which reflect light from the first mirror 232, an imaging lens 25 which forms light reflected by the second mirror unit 24 into an image on an image sensing element (to be referred to as a CCD hereinafter) 26, and the linear CCD 26 which photoelectrically converts the optical image formed by the imaging lens 25 to obtain image information.

Image information is subjected to proper image processing by an image processing unit (not shown), and then temporarily stored in a memory (not shown).

In the printing sheet storage section 4, feed trays 400, 410, and 420 respectively constituted by integrating storage vessels 405, 415, and 425 which store stacked printing sheets, and feed units 406, 416, and 426 serving as first feed units are vertically arranged. The feed units 406, 416, and 426 comprise feed rollers 407, 417, and 427, and separation rollers 408, 418, and 428 for preventing overlapping.

The image printing section 3 comprises a printing-head 31 serving as a printing unit having ink jet nozzles for discharging Y (Yellow), M (Magenta), C (Cyan), and K (blacK) color inks, a printing sheet support drum 32 (to be also simply referred to as a support drum hereinafter) which conveys a printing sheet while winding the sheet around the support drum 32, the light irradiation section 35 which cures a printed ink image to fix it onto the sheet surface, and a swing belt 39 which pushes up a printing sheet conveyed by registration rollers 57 to the surface of the support drum 32 in synchronism with the support drum 32. The swing belt 39 is looped between belt rollers 37 and 38, and can be pivoted to a position represented by the dotted line by using the rotating shaft of the belt roller 37 as a fulcrum.

The printing sheet feed section 5 comprises convey roller pairs (to be simply referred to as convey rollers hereinafter) R1, R2, R3, R4, R5, and R6 serving as convey members for conveying printing sheets from a plurality of feed trays to the image printing section 3. The convey roller pairs R1, R2, and R3 are preferably integrated as pre-registration rollers with the feed units 406, 416, and 426, and in the first embodiment, are integrated.

Reference symbol PS denotes a photo-sensor which has a function of detecting whether a printing sheet fed from the feed tray 400 (410 or 420) by the feed roller 407 (417 or 427) has reached the convey roller pair R1 (R2 or R3) arranged on the downstream of the separation roller 408 (418 or 428). The photo-sensor PS is arranged at a position immediately in front of the convey roller pair R1.

Reference numerals 55 denote convey rollers which are arranged on the downstream of the convey rollers R4. The convey rollers 55 are arranged at a convey path merging portion between a printing sheet fed via the ADU 8 and a printing sheet fed from, e.g., the feed tray 400. Reference numerals 56 denote convey rollers serving as second feed members.

The leading end of a printing sheet is synchronized with the support drum 32 by the registration rollers 57. The swing belt 39 pivots by using the shaft of the belt roller 37 as a fulcrum at a chucking portion T. As represented by the dotted line, the belt roller 38 pushes up to the chucking portion T the printing sheet conveyed by the registration rollers 57. The support drum has a suction hole, and air is sucked by a suction fan, thereby chucking and supporting the printing sheet from its leading end by the support drum 32. The swing belt 39 is so controlled as to return to the original position represented by the solid line after the leading end is chucked.

The supported printing sheet rotates clockwise together with the support drum 32, and is synchronized with ink discharge of the printing-head 31, thus printing in correspondence with Y, M, C, and K colors.

More specifically, information loaded into the image reading device 2 is converted into color image processing signals by an image processing unit. The printing-head 31 discharges ink in accordance with a write command generated by a control unit S. The printed printing sheet further rotates, and ink is cured and fixed onto the sheet by ultraviolet rays at a fixing portion F.

The image-fixed sheet is further conveyed. A separation claw 36 which is arranged near the chucking portion T abuts against the surface of the support drum 32 immediately before the leading end of the printing sheet by an abutment/abutment cancellation mechanism (not shown), and separates the printing sheet. The separation claw 36 is controlled such that its abutment is canceled from the surface of the support drum 32 when the leading end of the printing sheet is clamped between convey rollers 58.

The printing sheet is further conveyed by convey rollers 59, and supplied to the reversal delivery/refeed section 6.

The reversal delivery/refeed section 6 is a region for reversing and delivering an image-printed/fixed sheet, or refeeding a printing sheet in accordance with a double-side image printing mode. The reversal delivery/refeed section 6 comprises a switching member 62 which switches the convey path between a case wherein a printing sheet discharged by reversal discharge rollers 61 is directly discharged outside the apparatus via delivery rollers 63, a case wherein a printing sheet is discharged after it is reversed, and a case wherein a printing sheet is refed to the registration rollers 57 in order to print an image on the lower surface (second surface) of the printing sheet.

To directly discharge an image-printed sheet with its image surface facing down, the switching member 62 is located at a position represented by the chain line in FIG. 4. To reverse an image-printed sheet and then discharge it, the switching member 62 is located at a position represented by the solid line in FIG. 4. A printing sheet conveyed by the reversal discharge rollers 61 is supplied to a convey path having convey rollers 600, 610, and 620. At a timing when the trailing end reaches a position in front of the convey roller 600, the operation of the rollers is stopped. By reversing the rotational direction of the convey roller 600, the printing sheet is caused to pass through the left side of the switching member 62, and discharged to a delivery tray 64 outside the apparatus.

In a mode in which an image is to be printed on the second surface of a printing sheet, the switching member 62 is moved to the position represented by the solid line in FIG. 4. A printing sheet conveyed by the reversal discharge rollers 61 is supplied to the ADU 8 via the convey rollers of the reversal delivery/refeed section 6 driven by a delivery motor. After the printing sheet is reversed, it is supplied toward the registration rollers 57. After the printing sheet is processed by the same process as the above-described image printing, it is discharged to the delivery tray 64.

The ADU 8 is a reversal convey unit which reverses a printing sheet and forms part of a printing sheet circulation convey path (circulation path of the registration rollers 57, swing belt 39, reversal delivery/refeed section 6, ADU 8, and registration rollers 57). The ADU 8 comprises a plurality of roller pairs (to be also simply referred to as convey rollers hereinafter) 800, 810, 820, 830, 840, and 850. Of the convey rollers, the rollers 800 are driven and controlled in forward and backward directions by a motor (not shown), and called ADU reverse rollers.

A printing sheet for printing an image on the second surface is conveyed along the convey path by driving the rollers (600, 610, and 620) of the reversal delivery/refeed section 6. The printing sheet keeps moving in the same direction by driving the ADU reverse rollers 800. While the trailing end is clamped between the ADU reverse rollers 800, the printing sheet stops movement along with rotation stop operation of the ADU reverse rollers. After that, the printing sheet is switched back upon reception of the driving force of the ADU reverse rollers 800 which are rotated in a direction opposite to the rotational direction. The printing sheet enters the right convey path at the branch point, and while it is reversed, moves right through the horizontal convey path by driving the convey rollers 810 to 850. After the printing sheet moves up, it reaches the registration rollers 57 via the convey rollers 55 and 56. The printing sheet is processed by the same process as the above-described image printing, and then discharged to the delivery tray 64.

Image printing conditions as those described above are set via an operation panel serving as an operation unit.

Experimental examples when an ink jet printer having the arrangement shown in FIG. 1 printed an image by using ink prepared as follows will be explained.

Preparation of Ultraviolet Curing Ink Jet Yellow Ink:

| | |
|---|---|
| ultraviolet curing monomer (A-TMPT-3E0: available from Shin-Nakamura Chemical) | 7.3 mass % |
| photoinitiator (Irgacure 651: available from Ciba-Geigy) | 0.4 mass % |
| watercolor pigment dispersion (yellow pigment/water-soluble resin/water = 10/3/13.7 (mass ratio)) | 36.4 mass % |
| surface active agent (Noigen, 10% aq.: available from Dai-Ichi Kogyo Seiyaku) | 3.6 mass % |
| water-soluble solvent (IPA/NMP = 5/1 (mass ratio)) | 16.0 mass % |
| water | 36.4 mass % |
| water-soluble resin: styrene-acrylic acid copolymer | |

The following solution A and solution B were mixed at the above compositions. NMP and water were added, and the resultant solution was stirred for about 30 min to prepare yellow ink (IPA: isopropyl alcohol, NMP: N-methyl-2-pyrrolidone).

Preparation of Solution A:

IPA was added to an ultraviolet curing monomer (A-TMPT-3EO) while ultraviolet rays were cut, and the resultant solution was stirred for about 15 min. A photoinitiator (Irgacure 651) was added, and the resultant solution was stirred for 15 min to prepare solution A.

Preparation of Solution B:

A surface active agent (Noigen, 10% aq.) was added to a pigment ink (yellow pigment/water-soluble resin/water: the solid content of the yellow pigment was adjusted to 6 mass %), and the resultant solution was stirred for about 15 min to prepare solution B.

Preparation of Ultraviolet Curing Ink Jet Magenta, Cyan, and Black Inks:

Ultraviolet curing inks were prepared similarly to preparation of radiation curing ink jet yellow ink except that the pigment was replaced with magenta, cyan, and black ones.

Image Printing:

An ink jet printing apparatus with the arrangement shown in FIG. 1 using a piezoelectric ink jet head with 256 nozzles at a nozzle diameter of 24 μm printed on a printing sheet having a sheet width of 400 mm at a feed convey interval of 0.1 sec and a feed amount of 8.92 mm. The droplet size was about 7 pl, and the ink jet head was driven at a driving frequency of 10 kHz so as to discharge ink at a resolution of 720×720 dpi (dpi is the number of dots per 2.54 cm).

Four, yellow, magenta, cyan, and black color heads were mounted on a head carriage, and the ink set was set.

Light Irradiation:

A light-shielding member and light irradiation member were so arranged as to start irradiation 0.1 sec after image printing. A black light (FL40SBLB-A with a main wavelength of 365 nm available from Toshiba Lighting & Technology Corporation) was used as a light source, and light was emitted at a spot diameter of 8.92 mm and a scanning speed of 10,000 operations per 0.1 sec. Light irradiation was so controlled as to obtain a cumulative irradiation energy of 1000 mJ/cm$^2$ (irradiation energy of 3.568 mJ in one scanning). The light quantity sensor was UV Caremate PRO available from Fuji Xerox.

An image printed in the above way was clear without any blur, and no image omission was generated.

Figure 5:
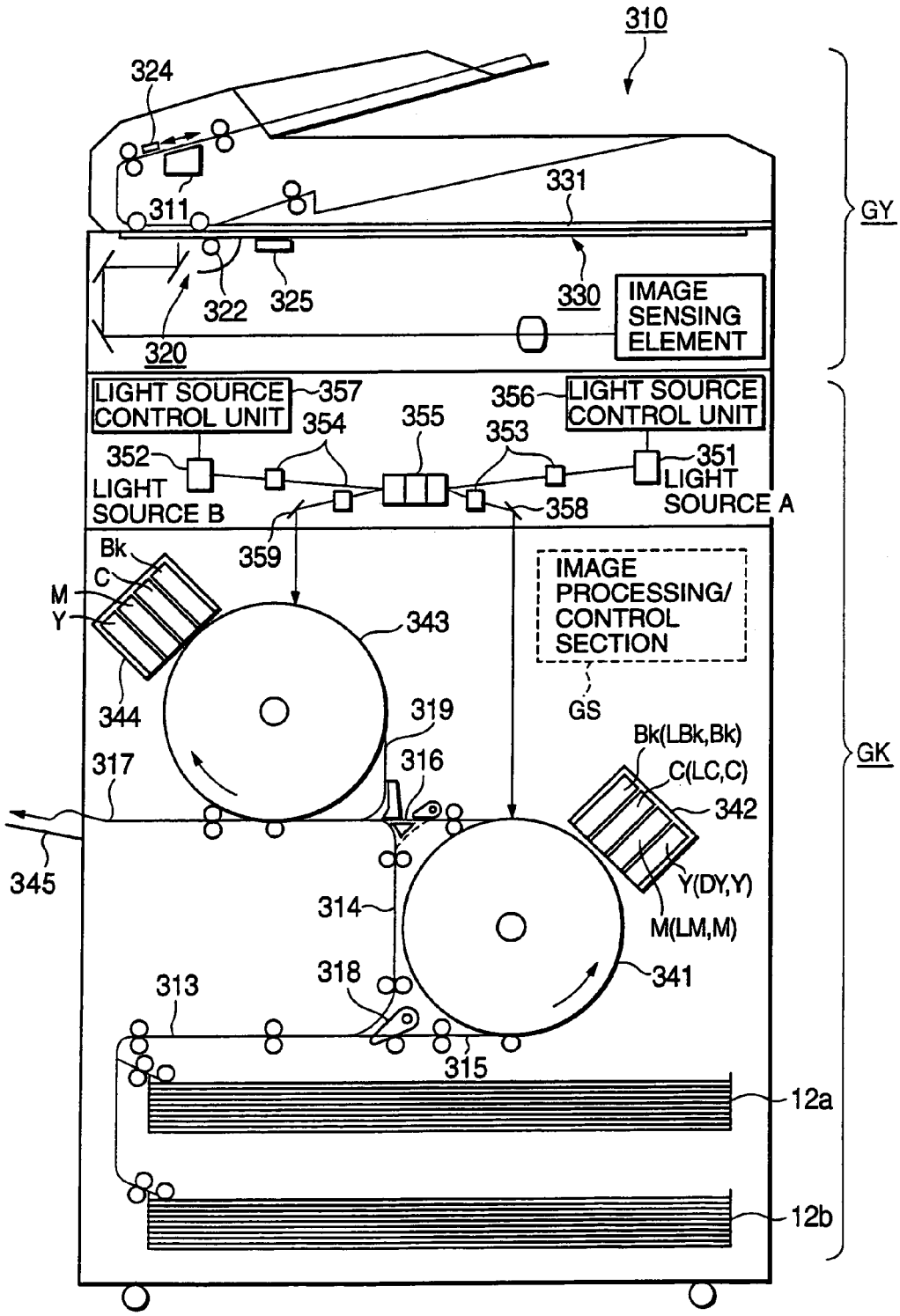
FIG. 5 is a sectional view showing the schematic arrangement of an image printing apparatus according to the second embodiment of the present invention.

FIG. 5 is a schematic view showing the whole arrangement of an image printing apparatus having the above-described ink jet printer according to the second embodiment.

The image printing apparatus of the ink jet printing system according to the second embodiment will be explained with reference to FIG. 5. The image printing apparatus according to the second embodiment comprises an image reading section GY, an image printing section GK, and an image processing/control section GS which performs image processing for image data of a read document image, and operation control of each mechanism. In the second embodiment, the image processing/control section GS is incorporated in the image printing section GK.

The image reading section GY is comprised of an automatic document feeding device 310, reading optical device 320, and document table reading device 330. The automatic document feeding device 310 incorporates a contact type image reading portion 311 which is arranged close to a fed document sheet and reads the image without the mediacy of any imaging optical system, and a white reference plate 324 for calibrating each color of the image reading portion 311. If necessary, the white reference plate 324 is moved to the position of the image reading portion 311 by a moving mechanism (not shown). The white reference plate 324 moves upon power-on or before reading operation, as needed, and is used for white balance adjustment or shading correction.

The reading optical device 320 and document table reading device 330 are identical to a reading device adopted in a conventional copying apparatus or the like, and are so constituted as to read a surface opposite to a surface read by the contact type image reading portion 311. The reading optical device 320 and document table reading device 330 have two functions: a document moving/reading function of irradiating a document sheet during conveyance to an image reading position with light from a light source 322 which stands still, and an optical system moving/reading function of moving the light source 322 or the like to irradiate with light a document sheet set on a glass document table (platen glass) 331 without using the automatic document feeding device 310. The reading optical device 320 is also equipped with a white reference plate 325.

The image printing section GK comprises storage trays 12*a* and 12*b* which store printing sheets, printing sheet convey paths 313, 314, 315, 316, 317, and 319, and a switching gate 318 for controlling the printing sheet convey direction. The switching gate 318 is operated by an actuator (not shown) in accordance with a control signal from a controller, and distributes a printing sheet conveyed from the storage tray 12*a* or 12*b* to the direction of the convey path 314 or 315.

A first printing sheet support drum 341 (first rotating drum) which rotates in a direction indicated by the arrow, and a line type first printing-head 342 (printing unit) having a plurality of nozzles for discharging photo-curing ink in a direction perpendicular to the printing sheet convey direction, i.e., main scanning direction are arranged along the convey path 315. A second printing sheet support drum 343 (second rotating drum) which rotates in a direction indicated by the arrow, and a second printing-head 344 (printing unit) identical to the first printing-head 342 are arranged along the convey paths 314 and 316. The first and second printing sheet support drums 341 and 343 rotate in the directions indicated by the arrows while winding printing sheets around them. The first and second printing-heads 342 and 344 print images with photo-curing ink.

The printing sheets on which the images are formed on the first and second printing sheet support drums 341 and 343 are irradiated with rays having a wavelength for curing photo-curing ink, thereby curing photo-curing ink.

A printing sheet is irradiated with rays emitted by a first light source 351 (light source A), controlled by a light source control unit 356, via a polygon mirror 355 which rotates, optical systems 353 which are arranged before and after the polygon mirror 355, and a reflecting mirror 358. At this time, rays reflected by the polygon mirror 355 which rotates at a predetermined rotational speed scan (optically scan) the first printing sheet support drum 341 in the main scanning direction perpendicular to the printing sheet convey direction, and irradiate the printing surface of a wound printing sheet at a predetermined spot diameter. Similarly, a printing sheet is irradiated with rays emitted by a second light source 352 (light source B), controlled by a light source control unit 357, via the polygon mirror 355, optical systems 354 which are arranged before and after the polygon mirror 355, and a reflecting mirror 359. Rays reflected by the polygon mirror 355 scan (optically scan) the second printing sheet support drum 343 in the main scanning direction perpendicular to the printing sheet convey direction, and irradiate the printing surface of a wound printing sheet at a predetermined spot diameter.

An optical system up to irradiation of a printing sheet by each light source is the same as that described in advance with reference to FIG. 1, and a detailed description thereof will be omitted.

The printing sheet bearing an image is delivered to a delivery tray 345 via the convey path 317.

Figure 6:
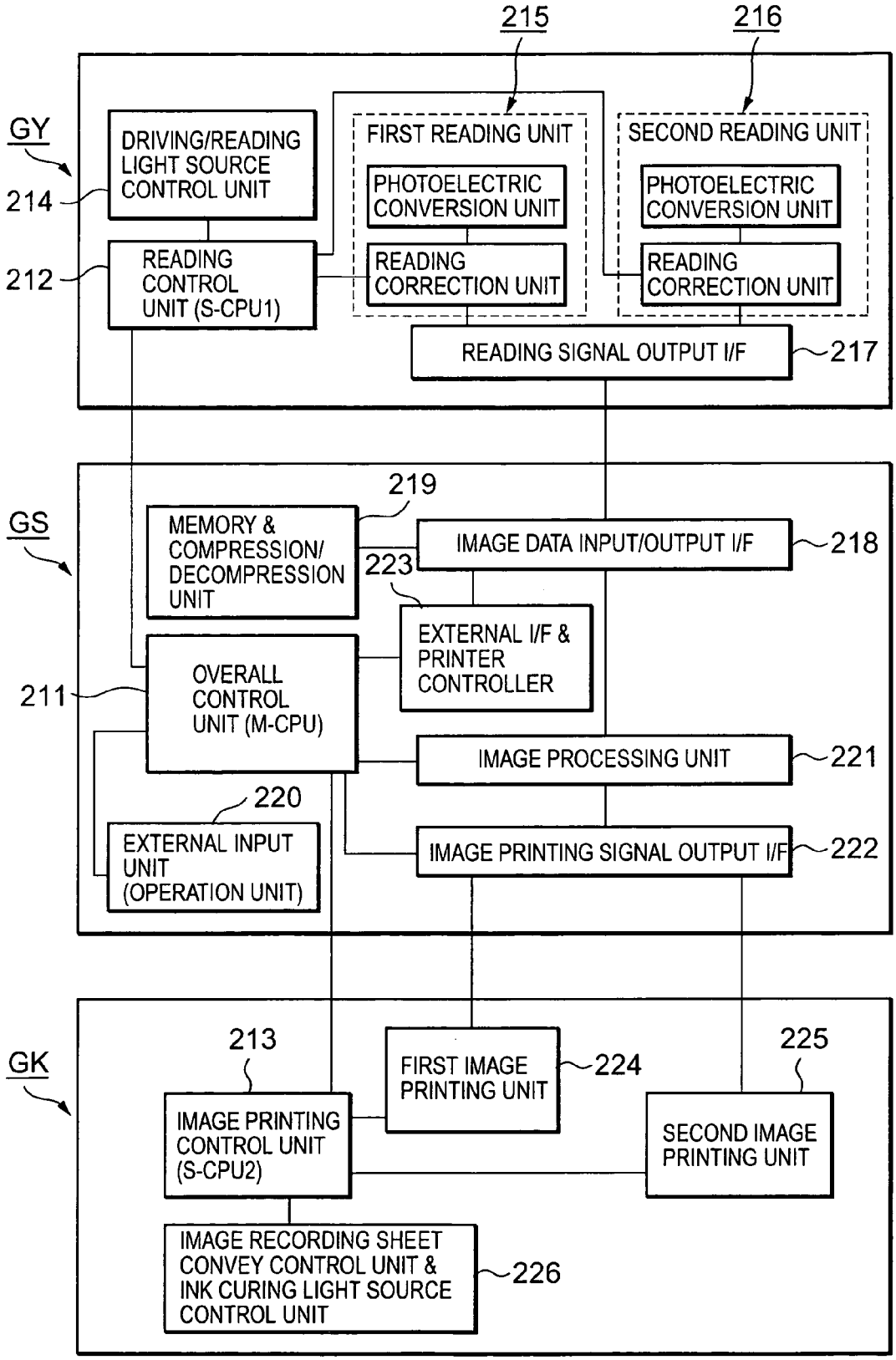
FIG. 6 is a block diagram showing the schematic arrangement of the image printing apparatus shown in FIG. 5.

FIG. 6 is a schematic block diagram showing the image printing apparatus shown in FIG. 5. As described in FIG. 5, the image printing apparatus according to the present invention is roughly classified by function into the image reading section GY, image processing/control section GS, and image printing section GK.

These sections are connected between an overall control unit (M-CPU) 211 in the image processing/control section GS, a reading control unit (S-CPU1) 212 in the image reading section GY, and an image printing control unit (S-CPU2) 213 in the image printing section GK. These sections communicate with each other to organically operate respective units in cooperation with each other.

In the image reading section GY, the reading control unit 212 controls a driving/reading light source control unit 214 which drives a reading device and controls a reading light source and the like, a first reading unit (corresponding to the contact type reading portion 311 in FIG. 5) 215 for reading one surface of a document sheet, and a second reading unit (corresponding to the reading optical device 320 and image sensing element in FIG. 5) 216 for reading the other surface. The image reading section GY also comprises a reading signal output I/F 217 which transfers image data of the read document sheet to an image data input/output I/F 218 of the image processing/control section GS.

The image processing/control section GS comprises the image data input/output I/F 218 which receives image data obtained by the image reading section GY under the control of the overall control unit 211, and a memory & compression/decompression unit 219 which compresses and stores transferred image data for each page, and decompresses the compressed image data. Examples of the compression/decompression unit are known JPEG, JPEG 2000, and JBIG. The image processing/control section GS also comprises an external input unit 220 which allows the operator to input the number of sheets, the number of copies, and the like, an image processing unit 221 which converts data so as to conform obtained image data to the image output format, and an image printing signal output I/F 222 which outputs the image data converted by the image processing unit 221 to the image printing unit of the image printing section GK. The image processing/control section GS further comprises an external I/F & printer controller 223 which receives an image photographed by a digital camera or image data read by another reading device, and prints an image in accordance with a command from an external device.

The image printing section GK comprises a first image printing unit (corresponding to the periphery of the first support drum 341 and first printing-head 342 in FIG. 5) 224 which prints an image in accordance with a signal from the image printing signal output I/F 222 under the control of the image printing control unit 213, a second image printing unit (corresponding to the periphery of the second printing sheet support drum 343 and second printing-head 344 in FIG. 5) 225, and a printing sheet convey control unit & ink curing light source control unit 226 which performs control of printing sheet conveyance, control of the switching gate 318, and control of an ink curing light source.

Operation around the printing sheet support drum will be explained with reference to FIG. 7 which is a sectional view showing the printing sheet convey path of the image printing unit and the main part of the printing unit in the image printing apparatus shown in FIG. 5.

Figure 7:
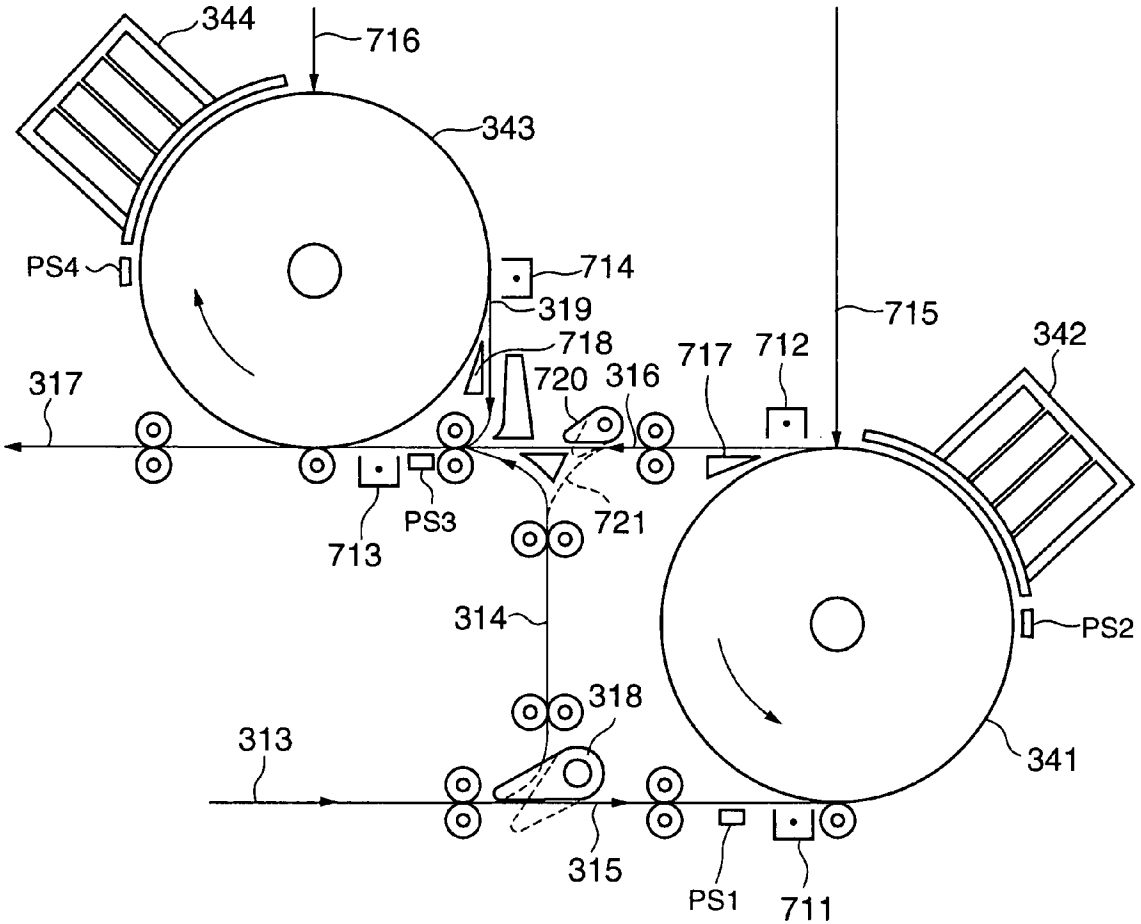
FIG. 7 is a sectional view of the main part showing a printing sheet convey path in an image printing unit.

In FIG. 7, components respectively represented by a double circle are convey rollers. Reference symbols PS1 to PS4 denote sensors (formed by photoreflectors in the second embodiment) which detect the leading/trailing end of a printing sheet and the presence/absence of a printing sheet. Reference numerals 711 and 713 denote chargers; and 712 and 714, charge removers.

A printing sheet is supplied from the storage tray 12*a* or 12*b* described above, and guided to the convey path 313. To convey the printing sheet to the first printing sheet support drum 341, the switching gate 318 is switched to a position represented by the solid line by an actuator (not shown), and the printing sheet is guided to the convey path 315. To directly convey the printing sheet to the second printing sheet support drum 343, the switching gate 318 is switched to a position represented by the broken line, and the printing sheet is guided to the convey path 314.

The printing sheet guided to the convey path 314 is guided to a direction indicated by the arrow. When the sensor PS3 detects the leading end of the printing sheet, the charger 713 is turned on to charge the sheet. The charger 713 is identical to a corona discharger used in a conventional copying apparatus or the like.

The printing sheet charged during conveyance is wound around the second printing sheet support drum 343, and rotated toward the second printing-head 344 (direction indicated by the arrow). When the sensor PS4 detects the leading end of the printing sheet, the second printing-head 344 starts printing after rotation at a predetermined rotation angle from the leading end detection position.

The second printing-head 344 prints an image on the basis of image data obtained by decompressing image data which is compressed and stored in the memory & compression/decompression unit 219 shown in FIG. 6, and processing the image data by the image processing unit 221.

The charger 713 is turned off a predetermined time after the sensor PS3 detects the trailing end of the printing sheet and the entire surface of the printing sheet is assumed to have passed through the charger. The charge remover 714 is turned on before the leading end of the printing sheet is assumed to reach the charge remover 714 upon rotation at a predetermined rotation angle from the leading end detection position after the sensor PS4 detects the leading end of the printing sheet.

The image-printed sheet having passed through the printing-head 344 by rotation of the second printing sheet support drum 343 is scanned with rays such as ultraviolet rays passing through an irradiation optical path 716 indicated by the arrow. As a result, the image formed by the second printing-head 344 with ultraviolet curing ink is cured, fixing the image. While this operation is executed the second printing sheet support drum 343 keeps rotating. The printing sheet is charge-removed at the position of the charge remover 714, and separated from the second printing sheet support drum 343 by a separation claw 718. The printing sheet passes through the convey path 319, and is delivered via the convey path 317. At this time, the leading end of the printing sheet bearing the image passes through the sensor PS3 again, but the charger 713 does not operate because of a predetermined OFF time.

When the switching gate 318 is switched to the position represented by the solid line, a printing sheet is guided to the convey path 315. The printing sheet guided to the convey path 315 is guided in a direction indicated by the arrow. When the sensor PS1 detects the leading end of the printing sheet, the charger 711 is turned on to charge the printing sheet. As described above, the printing sheet is wound around the first printing sheet support drum 341, and rotated toward the first printing-head 342 (direction indicated by the arrow). When the sensor PS2 detects the leading end of the printing sheet, the first printing-head 342 starts printing after rotation at a predetermined rotation angle from the leading end detection position.

The first printing-head 342 prints an image on the basis of image data obtained by decompressing image data which is compressed and stored in the memory & compression/decompression unit 219 shown in FIG. 6, and processing the image data by the image processing unit 221.

The charger 711 is turned off a predetermined time after the sensor PS1 detects the trailing end of the printing sheet and the entire surface of the printing sheet is assumed to have passed through the charger. The charge remover 712 is turned on before the leading end of the printing sheet reaches the charge remover 712 upon rotation at a predetermined rotation angle from the leading end detection position after the sensor PS2 detects the leading end of the printing sheet.

The image-printed sheet having passed through the first printing-head 342 by rotation of the first printing sheet support drum 341 is scanned with rays such as ultraviolet rays passing through an irradiation optical path 715 indicated by the arrow. Consequently, the image formed by the first printing-head 342 with ultraviolet curing ink is cured, fixing the image. While this operation is executed, the first printing sheet support drum 341 keeps rotating. The printing sheet is charge-removed at the position of the charge remover 712, and separated from the first printing sheet support drum 341 by a separation claw 717. The printing sheet passes through the convey path 316, and is delivered to the delivery tray 345 via the convey path 317. At this time, the leading end of the printing sheet bearing the image passes through the sensor PS3 again, but the charger 713 does not operate because of a predetermined OFF time. Hence, the printing sheet bearing the image is not wound around the second printing sheet support drum 343. As for charge removal of a printing sheet, a charge removing brush or the like may be added to the above arrangement.

The convey path 316 is equipped with a switching gate 720 for controlling a convey path in delivery. The switching gate 720 is set in a state represented by the solid line in double-side image printing, and a printing sheet passes straight through the convey path 316. In single-side image printing, the switching gate 720 pivots to a position represented by the broken line. A printing sheet from the first printing sheet support drum 341 is conveyed to the convey path 314 via a convey path 721 (represented by the broken line), switched back, and delivered via the convey path 317.

Operation of printing images on two sides by the above arrangement will be explained.

The switching gate 318 is switched to the position represented by the solid line. A printing sheet is conveyed from the convey path 313 to the convey path 315, charged by the charger 711, and then wound around the first printing sheet support drum 341. An image is formed and ink is cured on one surface of the printing sheet on the first printing sheet support drum 341. The printing sheet is charged by the charger 713 via the convey path 316, and wound around the second printing sheet support drum 343. An image is formed and ink is cured on the other surface of the printing sheet on the second printing sheet support drum 343. The printing sheet having undergone double-side image printing is delivered onto the delivery tray 345 via the convey paths 319 and 317.

Operation of printing an image on one surface by the above arrangement will be explained.

The switching gate 318 is switched to the position represented by the broken line, and the first printing sheet is wound around the second printing sheet support drum 343 via the convey paths 313 and 314. An image is formed and ink is cured on one surface. The switching gate 318 is switched to the position represented by the solid line, and the second printing sheet is wound around the first printing sheet support drum 341 via the convey paths 313 and 315. An image is formed and ink is cured on one surface.

The printing sheet bearing the image which is formed on one surface on the second printing sheet support drum 343 is delivered via the convey paths 319 and 317. The printing sheet bearing the image which is formed on one surface on the first printing sheet support drum 341 is conveyed from the convey path 721 to the convey path 314 because the switching gate 720 is switched to the position represented by the broken line. The printing sheet is switched back, and then delivered via the convey path 317.

In this way, the printing speed can be increased by successively forming images on the two printing sheet support drums 341 and 343 for each printing sheet.

Note that switchback operation is to orient stacked image surfaces in the same direction after delivery.

What is claimed is:

1. An image printing apparatus of an ink jet printing system, comprising:

first and second rotary drums adapted to have a printing sheet wound therearound;

first and second ink jet printing heads which correspond respectively to the first and second rotary drums, and each of which discharges photo-curing ink in order to print an image on the printing sheet wound around the corresponding rotary drum;

a first irradiation optical path along which rays are irradiated to a first image printing surface of the printing sheet wound around the first rotary drum;

a second irradiation optical path along which rays are irradiated to a second image printing surface of the printing sheet wound around the second rotary drum; and light irradiation means for irradiating the rays along the first and second irradiation optical paths to irradiate the image printing surfaces by optical scanning via a reflecting mechanism;

wherein the printing sheet is wound around the first rotary drum with the first image printing surface facing outward, and is then wound around the second rotary drum with the second image printing surface facing outward.

2. An apparatus according to claim 1, wherein the reflecting mechanism comprises a polygon reflecting mirror.

3. An apparatus according to claim 2, wherein the reflecting mechanism comprises a swingable reflecting mirror.

4. An apparatus according to claim 3, further comprising detection means for detecting a light quantity, and light quantity control means for controlling an irradiation energy amount based on the detected light quantity.

5. An apparatus according to claim 2, further comprising detection means for detecting a light quantity, and light quantity control means for controlling an irradiation energy amount based on the detected light quantity.

6. An apparatus according to claim 1, further comprising detection means for detecting a light quantity, and light quantity control means for controlling an irradiation energy amount on the basis of the detected light quantity.

7. An apparatus according to claim 1, wherein the reflecting mechanism comprises a polygon reflecting mirror which rotates, and the light irradiation means comprises first and second light sources which emit respective rays that are reflected by the polygon reflecting mirror to be irradiated along the first and second irradiation optical paths.

8. A printer according to claim 7, further comprising detection means for detecting a light quantity, and light quantity control means for controlling an irradiation energy amount based on the detected light quantity.

9. An apparatus according to claim 1, wherein the reflecting mechanism comprises a swingable reflecting mirror which rotates, and the light irradiation means comprises first and second light sources which emit respective rays that are reflected by the reflecting mirror to be irradiated along the first and second irradiation optical paths.

10. A printer according to claim 9, further comprising detection means for detecting a light quantity, and light quantity control means for controlling an irradiation energy amount based on the detected light quantity.

* * * * *